US005080180A

United States Patent [19]

Hansson

[11] Patent Number: 5,080,180

[45] Date of Patent: Jan. 14, 1992

[54] TORQUE IMPULSE POWER TOOL

[75] Inventor: Gunnar C. Hansson, Stockhölm, Sweden

[73] Assignee: Atlas Copco Tools AB, Stockholm, Sweden

[21] Appl. No.: 435,694

[22] Filed: Nov. 13, 1989

[30] Foreign Application Priority Data

Nov. 14, 1988 [SE] Sweden ..... 8804097

[51] Int. Cl.[5] ..... B25D 15/00

[52] U.S. Cl. ..... 173/93; 188/166; 192/170

[58] Field of Search ..... 173/12, 93, 93.5; 188/166; 192/17 D

[56] References Cited

U.S. PATENT DOCUMENTS 2,662,434 12/1953 Burkhardt .
3,369,615 2/1968 Maffey, Jr. et al. ..... 173/93.6
4,019,589 4/1977 Wallace ..... 173/12
4,691,786 9/1987 Fujita et al. ..... 173/12
4,871,033 10/1989 Odoni et al. ..... 173/12

*Primary Examiner*—Timothy V. Eley
*Assistant Examiner*—William Fridie, Jr.
*Attorney, Agent, or Firm*—Frishauf, Holtz, Goodman & Woodward

[57] ABSTRACT

A torque impulse power tool primarily intended for tightening threaded joints comprises a housing (10), a rotation motor (11), a torque impulse generating mechanism (13), and a reduction gearing (12) coupling the impulse mechanism (13) to the motor (11). A torsion spring (21) is associated with the reduction gearing (12) to reduce substantially the difference in deceleration between the motor (11) and the impulse mechanism (13) by yielding elastically to the driving and inertia forces of the motor (11) and the gearing (12) during each impulse generation. The torsion spring (21) is connected to absorb the reaction torque peaks developed in the gearing (12) or the driving torque peaks between the gearing (12) and the impulse mechanism (13).

8 Claims, 1 Drawing Sheet

TORQUE IMPULSE POWER TOOL

BACKGROUND OF THE INVENTION

This invention relates to a torque impulse power tool primarily intended for tightening of threaded joints. In particular, the invention concerns a torque impulse power tool of the type comprising a housing, a rotation motor, a torque impulse generating mechanism, and a reduction gearing coupling the impulse mechanism to the motor.

A problem inherent in power tools of the above type concerns the undesireable vibrations transferred to the housing via the reduction gearing, vibrations that are caused by the driving and inertia forces of the motor and the reduction gearing during the abrupt deceleration caused the impulse mechanism at each impulse generation. A power tool of this type is described in U.S. Pat. No. 2,907,239.

The primary object of the invention is to solve the abovementioned vibration transfer problem.

Another object of the invention is to increase the power output of the motor and the tool by increasing the average speed of the motor during operation.

These and other objects are achieved by the invention as it is defined in the claims.

Embodiments of the invention are below described in detail with reference to the accompanying drawing.

DETAILED DESCRIPTION

Figure 1:
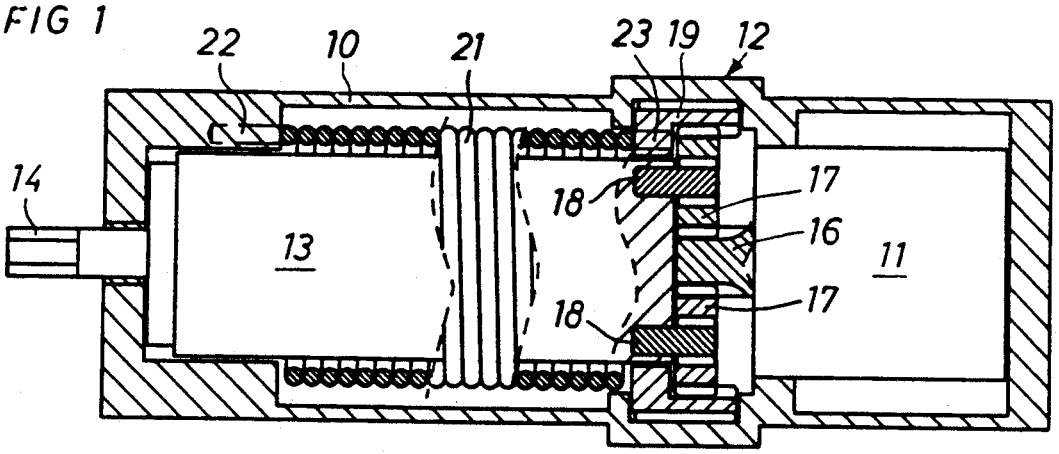
FIG. 1 shows a longitudinal section through a torque impulse power tool according to one embodiment of the invention.

Both of the power tools illustrated in the drawing figures are intended for screw joint tightening purposes and comprise a housing 10, a rotation motor 11, a planetary reduction gearing 12, a hydraulic torque impulse generator 13 and an output shaft 14. The latter is intended to carry a nut socket or the like for connection to a screw joint to be tightened.

The hydraulic torque impulse generator 13 may be of any conventional type available today on the market.

The motor 11, which may be a pneumatic vane motor or an electric motor, is connected to a power source via a non-illustrated supply means. The motor 11 has a toothed output shaft 16 for driving engagement with two planet wheels 17 of the planetary reduction gearing 12.

In the embodiment shown in FIG. 1, the planet wheels 17 are journalled on stub axles 18 which are rigidly mounted on the impulse mechanism 13. The planet wheels 17 engage a ring gear 19 which is rotatably supported in the housing 10.

A coil type torsion spring 21 envelops the impulse mechanism 13 and is connected at its one end 22 to the housing 10 and at its opposite end 23 to the ring gear 19.

In operation, rotational power is delivered from the motor 11 to the reduction gearing 12 via the motor shaft 16 and is transferred via the planet wheels 17 and stub axles 18 to the impulse generator 13. Due to the resistance applied on the output shaft 14 from the screw joint being tightened, the impulse generator starts generating torque impulses. Each impulse generating cycle comprises an acceleration phase in which the motor 11 and the driving part of the impulse generator 13 gain kinetic energy, and an impulse generating phase in which a hydraulic coupling of the driving and driven parts of the generator takes place. Hereby, the motor torque as well as the kinetic energy of the motor, the reduction gearing and the driving part of the impulse generator is transferred to the driven part of the generator and the output shaft 14. During this transfer of energy, an abrupt deceleration is imparted on the motor 11 and the reduction gearing 12.

That part of the kinetic energy of the motor 11, which during this abrupt deceleration is transferred as a reaction torque to the ring gear 19 via planet wheels 17, results in a winding of torsion spring 21. This means that the spring 21 absorbs by elastic deformation that part of the kinetic energy that would otherwise have been transferred directly to the housing 10 as an undesirable vibration impulse. During the subsequent acceleration phase, the energy stored as an elastic deformation of the torsion spring 21 is transferred back to the ring gear 19 and, thereby, back to the drive train to add to the torque delivered by the motor 11. The torsion spring 21, together with the reduction gearing 12, effectively comprise a transmission for coupling the motor 11 to the hydraulic torque impulse generator 13.

Figure 2:
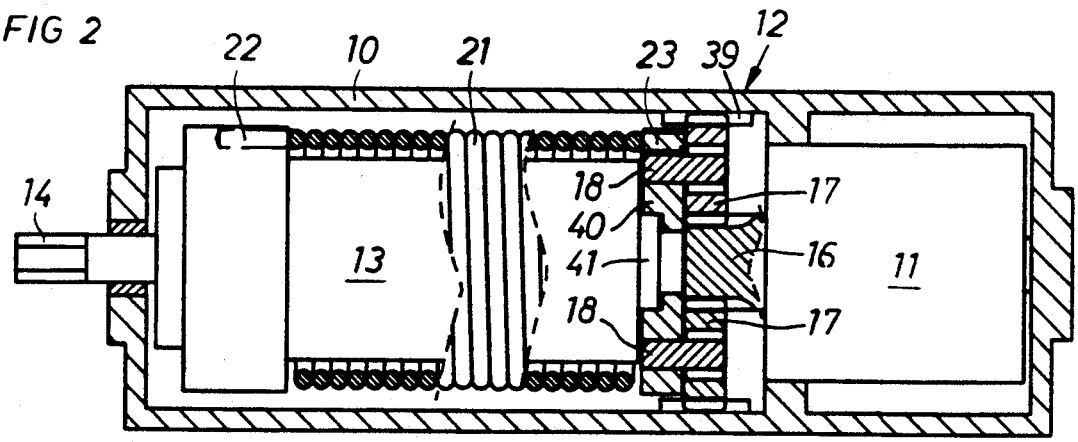
FIG. 2 shows in a similar manner another embodiment of the invention.

In the power tool shown in FIG. 2, the main parts which have a function and design similar to those in the previous embodiment have been designated with the same numerals. One important difference in relation to the tool shown in FIG. 1 is that the reduction gearing 12 of the tool in FIG. 2 comprises a non-rotatable ring gear 39. The latter forms part of the housing 10.

Another, likewise important difference in the reduction gearing is that, in the latter embodiment, the planet wheel supporting stub axles 18 are mounted on a rotatable ring element 40. The latter is in turn supported on a rear coaxial extension of the driving part of the impulse generator 13.

A third difference in relation to the previously described embodiment is that the forward end 22 of the torsion spring 21 is connected to the impulse generator 13, whereas the rear end of the spring 21 is connected to the planet carrier ring 40. This means that the driving torque delivered by the motor 11 is transferred to the impulse generator through the planet carrier ring 40 and the torsion spring 21. During the abrupt deceleration imparted on the drive train and the motor 11 at each impulse generation, the kinetic energy of the rotating parts of the motor 11, the gearing 12 and the spring 21 itself will be absorbed elastically by the spring 21. As in the previous embodiment, vibration impulses to the housing 10 transferred via the reduction gearing 12 are substantially avoided, and the energy stored in the spring 21 during impulse generation is utilized during the subsequent acceleration phase.

Apart from obtaining a substantially vibration free impulse tool, the arrangement according to the invention also makes it possible to gain more power from the motor. The reason is that the elasticity of the torsion spring associated with the reduction gearing prevents the motor from being stopped or almost stopped during each impulse generation. Instead, the average motor speed is increased as is the output power. The torsion spring arrangement according to the invention also makes possible to use an electric motor which must not be stopped under full power supply.

The arrangement according to the invention is advantageous also in that the impulse generator could be made more effective. This is obtained by reducing the bypass flow of the hydraulic coupling means of the impulse generator. The result is that the driving part of the impulse generator is decelerated more abruptly and moves even slower at the end of the impulse generating phase. This is possible to achieve since the motor, despite of that, retains some of its speed and kinetic energy until the subsequent acceleration phase starts.

I claim:

1. A hydraulic torque impulse power tool, comprising:

a housing (10), a rotation motor (11), a hydraulic torque impulse generating mechanism (13), and transmission means (12, 21) for coupling said hydraulic torque impulse generating mechanism (13) to said rotation motor (11), said transmission means including:

a reduction gearing (12) coupled to said rotation motor (11); and torsion spring means (21), coupled at one end portion thereof to said reduction gearing (12), and arranged to yield elastically to driving and inertia forces of said rotation motor (11) and said reduction gearing (12) during each impulse generation of said hydraulic torque impulse generating mechanism 13).

2. Power tool according to claim 1, wherein said reduction gearing (12) comprises a planetary gear, including a ring gear (19) which is rotatively supported in the housing (10), said torsion spring means (21) being connected between said ring gear (19) and the housing (10).

3. Power tool according to claim 1, wherein said torsion spring means (21) comprises a cylindrical coil spring.

4. Power tool according to claim 1, wherein said torsion spring means (21) is connected between said reduction gearing (12) and said impulse mechanism (13).

5. Power tool according to claim 3, wherein said impulse mechanism (13) has a substantially cylindrical outer shape, said torsion spring means (21) being arranged to at least partly envelop said impulse mechanism (13).

6. Power tool according to claim 4, wherein said torsion spring means (21) comprises a cylindrical coil spring.

7. Power tool according to claim 6, wherein said impulse mechanism (13) has a substantially cylindrical outer shape, said torsion spring means (21) being arranged to at least partly envelop said impulse mechanism (13).

8. Power tool according to claim 1, wherein said torsion spring means (21) is connected between said reduction gearing (12) and said housing (10).

* * * * *